US008400256B2

(12) United States Patent
Matthews

(10) Patent No.: US 8,400,256 B2
(45) Date of Patent: Mar. 19, 2013

(54) GLOVE WITH A PARTICULARIZED ELECTRO-CONDUCTIVITY FEATURE

(76) Inventor: Sam Matthews, Hendersonville, NC (US)

( * ) Notice: Subject to any disclaimer, the term of this patent is extended or adjusted under 35 U.S.C. 154(b) by 201 days.

(21) Appl. No.: 12/860,103

(22) Filed: Aug. 20, 2010

(65) Prior Publication Data

US 2012/0042437 A1 Feb. 23, 2012

(51) Int. Cl.
*H01C 10/10* (2006.01)

(52) U.S. Cl. ..... 338/99; 2/164

(58) Field of Classification Search ..... 338/99; 2/164

See application file for complete search history.

(56) References Cited

U.S. PATENT DOCUMENTS

| | | | | |
|---|---|---|---|---|
| 3,132,348 | A * | 5/1964 | Frenkel et al. | 2/167 |
| 6,128,004 | A * | 10/2000 | McDowall et al. | 345/158 |
| 7,874,021 | B2 * | 1/2011 | Sunder et al. | 2/163 |
| 2004/0009731 | A1 * | 1/2004 | Rabinowicz | 442/316 |
| 2009/0000010 | A1 * | 1/2009 | Sunder et al. | 2/163 |
| 2009/0183297 | A1 * | 7/2009 | Drosihn | 2/167 |
| 2010/0090966 | A1 * | 4/2010 | Gregorio | 345/173 |

* cited by examiner

*Primary Examiner* — Kyung Lee
(74) *Attorney, Agent, or Firm* — Russell W. Warnock

(57) ABSTRACT

A hand covering that may be in the form of a glove includes at least one finger receptacle having a sheath wall with an external surface and an internal surface, an outer strand having a metallic component and an inner strand. The outer strand includes a portion that extends into the sheath wall of the receptacle such that the portion of the outer strand does not cross the interior surface of the sheath wall of the receptacle. The outer strand and the inner strand are associated with one another such that, when a finger of a user is accommodated in the at least one receptacle, an electrical conductivity path exists that includes the finger of the user, the inner strand, and the outer strand.

19 Claims, 9 Drawing Sheets

GLOVE WITH A PARTICULARIZED ELECTRO-CONDUCTIVITY FEATURE

BACKGROUND OF THE INVENTION

The present invention relates to a glove whose unique features that provide one with the ability to text, touch and swipe a touch screen which can be desk size or hand held size with pin point accuracy. This accuracy is achieved with a glove formed of a soft compliant flexible conductive material which conforms to the finger tip profile of the user. The conductive material is present in the finger tip but does not detract from the normal dexterity, tactility and utility of the glove. The present invention in a broad sense relates to a finger covering having a particularized electro-conductivity feature and, more particularly, to a finger covering in the form of a glove having a particularized electro-conductivity feature for targeted activation of electronic device screens.

Electronic devices often include a computer-generated touch screen for the sake of convenience, mobility, and practical utility, the computer-generated touch screen being provided in lieu of a stand-alone keyboard. The computer-generated touch screen permits an operator to enter and manage data electronically. Typically, sensing controls or softkeys are presented to the operator on the touch screen, which permit the input of information or data commands, and likewise permit the device to receive and organize data, as well as execute corresponding commands. A person wearing a glove or a mitten may well have to remove the glove or mitten completely to use a mobile phone or other electronic device having such a computer-generated touch screen, in order that the person can complete transactions with the computer-generated touch screen with the requisite manual dexterity. In contrast to certain electronic devices that comprise data entry buttons raised relative to a base surface of the device, electronic devices comprising a touch screen require an interaction in which a capacitance feature of the touch screen is interrupted via, for example, a change in electrical conductivity at the selected local site of the touch screen. Thus, at least one stall or finger receptacle of the glove or mitten must typically be removed to thereby expose a finger so that the no-longer covered finger can be used to activate the touch screen. However, when in weather conditions that are cold, wet or otherwise unpleasant, or in circumstances in which it would be uncomfortable and unwieldy to expose a finger, the lack of a capability to activate a touch screen without uncovering a finger is a drawback of such heretofore available gloves and mittens.

Thus, there are benefits in convenience and usefulness that could be realized if a finger covering, or a hand covering extending over several fingers, were available that permits a wearer of the hand covering to precisely and conveniently activate the functions on a touch screen or other capacitance activated interface without the need to fully or partially remove the finger or hand covering.

SUMMARY OF THE INVENTION

It is therefore an object of the present invention to provide a hand covering were available that permits a wearer of the hand covering to precisely and conveniently activate the functions on a touch screen or other capacitance activated interface without the need to fully or partially remove the hand covering.

According to one aspect of the present invention, there is provided a hand covering comprising at least one receptacle, the receptacle having a sheath wall with an external surface and an internal surface, the internal surface delimiting a receiving volume in which one or more fingers of a user can be accommodated and the external surface and the internal surface delimiting therebetween the interior of the sheath wall. It also has an outer strand, the outer strand having a metallic component and the outer strand being secured to the external surface of the receptacle at least two securement locations spaced from one another in a length direction. The outer strand has at least one portion that extends into the external surface of the sheath wall of the receptacle at one entrance location on the external surface of the sheath wall, passes along a passage in the sheath wall interior, and extends outwardly of the external surface of the sheath wall at an exit location of the external surface of the sheath wall such that the at least one portion of the outer strand does not cross the interior surface of the sheath wall of the receptacle. It also has an inner strand, the inner strand having a metallic component and the inner strand being secured to the internal surface of the receptacle. The outer strand and the inner strand are associated with one another such that, when a finger of a user is accommodated in the at least one receptacle, an electrical conductivity path exists that includes the finger of the user, the inner strand, and the outer strand. The outer strand and the inner strand are arranged relative to one another in a selected one of the following arrangements: (a) an arrangement characterized by the absence of an interconnecting element extending through the sheath wall of the receptacle and connected to both the inner strand and the outer strand or (b) an arrangement characterized by at least one interconnecting element extending through the sheath wall of the receptacle and connected to both the inner strand and the outer strand.

According to a further feature of the one aspect of the present invention, the outer strand and the inner strand being arranged relative to one another in an arrangement characterized by at least one interconnecting element extending through the sheath wall of the receptacle and connected to both the inner strand and the outer strand. The outer strand has a pair of ends, and the interconnecting element is connected to the outer strand solely at a respective one of the pair of ends of the outer strand.

According to a further feature of the one aspect of the present invention, the inner strand has a pair of ends, and the interconnecting element is connected to the inner strand solely at a respective one of the pair of ends of the inner strand.

According to a further feature of the one aspect of the present invention, the hand covering further comprises a target assist feature on the external surface of the sheath wall of the receptacle. The target assist feature is in a predetermined relationship with the outer strand and is operable to provide feedback to the user relating to a position of the outer strand.

According to another aspect of the present invention, there is provided a glove comprising a plurality of five receptacles, each receptacle having a sheath wall with an external surface and an internal surface, the internal surface delimiting a receiving volume in which a finger of a user can be accommodated. The internal surface of each receptacle delimits therebetween the interior of the sheath wall, and each receptacle has a tip portion in which a fingertip of a finger of the user is received and a base portion in which a base of a finger of the user is received. Each receptacle has a longitudinal axis delimited by the tip portion and the base portion. There is also an outer strand, the outer strand having a metallic component and the outer strand being secured to the external surface of a respective one of the receptacles at least two securement locations spaced from one another in the longitudinal direction. The outer strand has at least one portion that extends into the external surface of the sheath wall of the receptacle at one entrance location on the external surface of the sheath wall, passes along a passage in the sheath wall interior, and extends outwardly of the external surface of the sheath wall at an exit location of the external surface of the sheath wall such that the at least one portion of the outer strand does not cross the interior surface of the sheath wall of the receptacle, and the outer strand has a pair of ends. It also has an inner strand, the inner strand having a metallic component and the inner strand being secured to the internal surface of the one receptacle at least two securement locations spaced from one another in the longitudinal direction. The inner strand has a pair of ends, the outer strand and the inner strand are substantially parallel to one another and are in at least partial overlapping relationship with one another as viewed relative to the longitudinal direction. The outer strand and the inner strand are associated with one another such that, when a finger of a user is accommodated in the at least one receptacle, an electrical conductivity path exists that includes the finger of the user. The outer strand and the inner strand are arranged relative to one another in an arrangement characterized by at least one interconnecting element extending through the sheath wall of the receptacle and connected to both the inner strand and the outer strand, and the interconnecting element is connected to the outer strand solely at a respective one of the pair of ends of the outer strand. The interconnecting element is connected to the inner strand solely at a respective one of the pair of ends of the inner strand.

The invention accordingly comprises the features of construction, combinations of elements and arrangements of parts which will be exemplified in the construction as hereinafter set forth, and the scope of the invention will be indicated in the claims.

DETAILED DESCRIPTION OF AN EMBODIMENT

Figure 1:
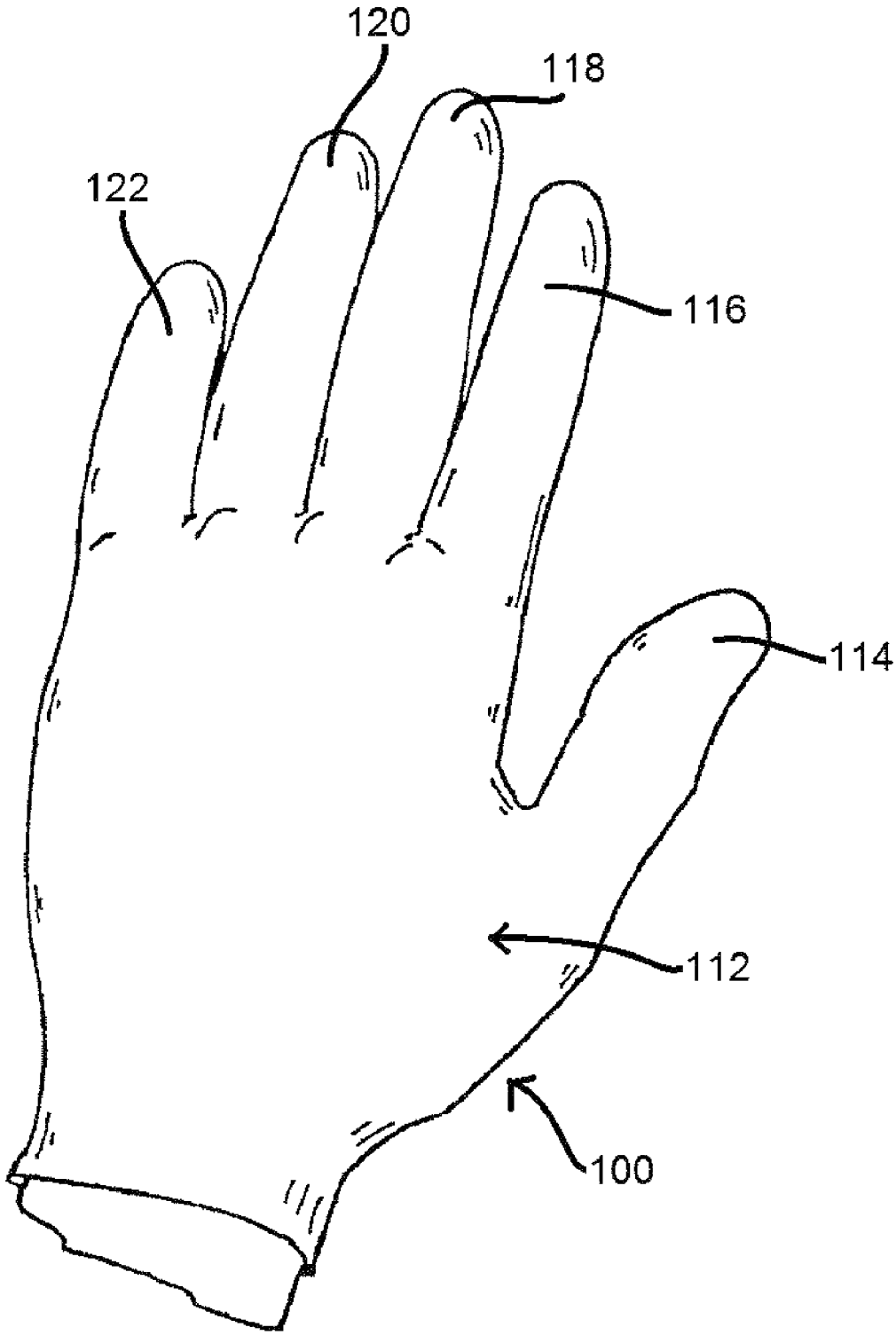
FIG. 1 is a top perspective view of one embodiment of the hand covering of the present invention.
Figure 2:
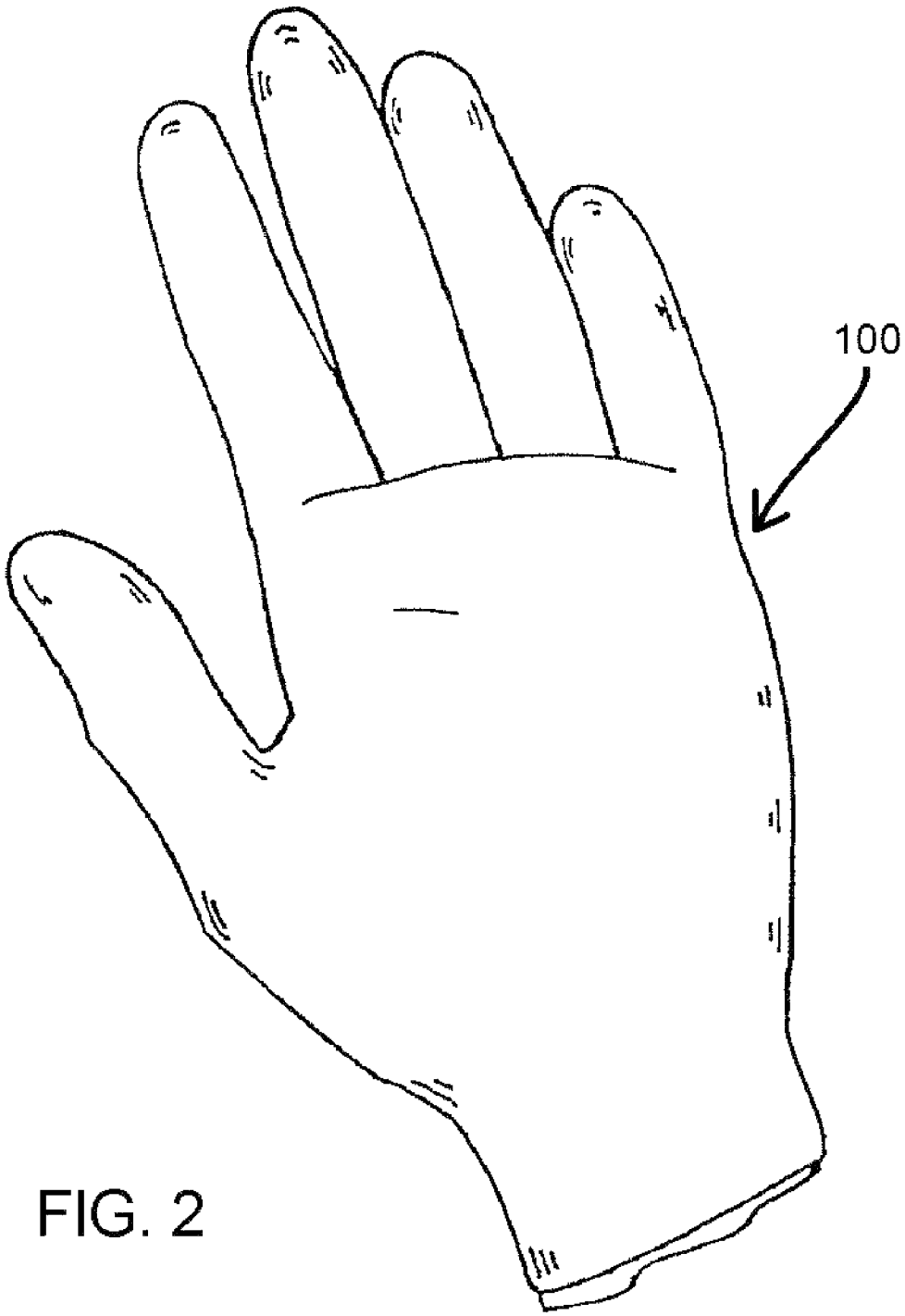
FIG. 2 is a bottom perspective view of one embodiment of the hand covering of the present invention shown in FIG. 1.

With reference now to FIG. 1, which is a top perspective view of one embodiment of the hand covering of the present invention, and FIG. 2, which is a bottom perspective view of one embodiment of the hand covering of the present invention shown in FIG. 1, the hand covering 100 is exemplarily illustrated as the left hand version of a glove pair having a five-fingered left hand glove and a five fingered right hand glove (not shown). The hand covering 100 includes a shell 112 comprised of five receptacles, each for individually accommodating a respective finger of a wearer of the hand covering 100. The shell 112 includes a thumb finger receptacle 114, an index finger receptacle 116, a middle finger receptacle 118, a ring finger receptacle 120, and a pinky finger receptacle 122.

The hand covering 100 also includes a conductivity enhancing sub-assembly 124, seen in FIG. 2, that renders the hand covering 100 particularly suitable for a person using a mobile phone or other electronic device that requires manual dexterity such as, for example, a personal data assistant, wireless e-mail device or the like. The conductivity enhancing sub-assembly 124, which is described in more detail shortly, is advantageously configured such that it can be provided on a wide range of hand coverings 100 both as an installation during manufacture of the respective hand covering or as a finished product add-on that is installed on a respective hand covering at a time after an end user has already purchased or acquired the hand covering. Moreover, the conductivity enhancing sub-assembly 124 can be provided in a configuration in which the conductivity enhancing sub-assembly 124 renders the respective hand covering on which it is deployed suitable for use as a hand covering that can remain on a user's hand while the user grasps any one of a wide range of electronic devices. While certain electronic devices comprise data entry buttons that are raised relative to a base surface of the device, other electronic devices comprise a touch screen and activation of the touch screen requires electrical conductivity. In particular when weather conditions are cold, wet or otherwise unpleasant, or in circumstances in which it would be uncomfortable and unwieldy to expose a finger, the hand covering 100 offers the desirable capability to the wearer that the wearer can activate a touch screen without uncovering a finger or any other portion of the hand covered by the hand covering.

An electronic device that employs a display may be configured as a system, subscriber unit, subscriber station, mobile station, mobile, remote station, remote terminal, access terminal, user terminal, terminal, wireless communication device, user agent, user device, or user equipment. The electronic device can include electronic systems, such as, but not limited to a cellular telephone, a cordless telephone, a wireless local loop (WLL) station, a personal digital assistant (PDA), a handheld electronic device, a laptop, an automated teller machine (ATM), a computing device, a media player, a media recorder, a camera, etc., or a combination thereof. A touch screen can be configured as a "conductive touch screen", "capacitive touch screen", "skin sensitive touch screen" and "screen" and can be understood to be a screen that detects touch based on conduction of an object touching the screen. The display, for example, may comprise a liquid crystal display, an organic light emitting device, a cathode ray tube, and/or the like.

As portable electronic appliances become more ubiquitous, the array of portable electronic devices provided with a touch sensitive surface as a means of providing user input has expanded as well and such portable electronic devices include, but should not be considered limited to, music players, DVD players, video file players, personal digital assistants (PDAs), digital cameras and camcorders, mobile telephones, smart phones, laptop and notebook computers, global positioning satellite (GPS) devices and other portable electronic devices. Additional suitable electronic devices include a pager, a mobile television, a gaming device, a camera, a video recorder, an audio player, a video player, a radio, a mobile telephone, a traditional computer, a portable computer device, a global positioning system (GPS) device, a browsing device, an electronic book reader, or a combination of the above-noted devices.

Figure 4:
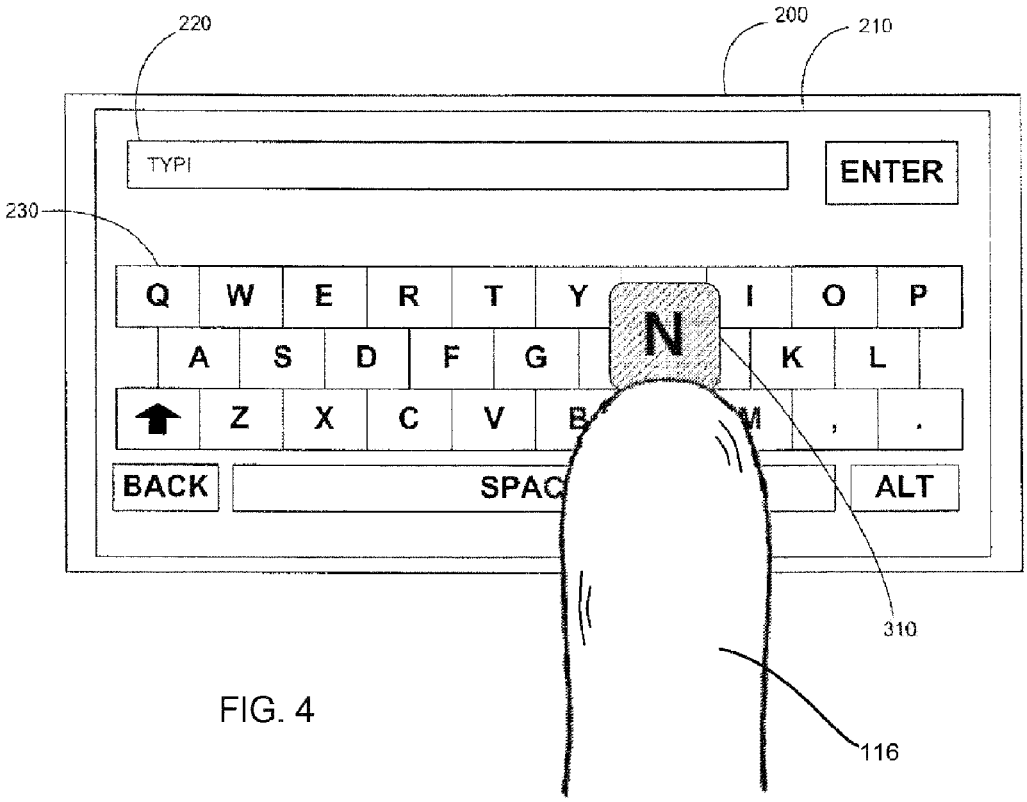
FIG. 4 is a top elevational view of a touch screen on a mobile smart phone that is amenable to activation by a wearer of the hand covering.

One category of mobile smart phones provide a liquid crystal display (LCD) having touch sensitive screen capabilities. Reference is now had to FIG. 4, which is a top elevational view of a touch screen 200 on a mobile smart phone that is amenable to activation by a wearer of the hand covering 100. The touch screen 200 displays a virtual keyboard 210. The virtual keyboard 210 comprises a text input area 220, a plurality of selectable objects 230, and/or the like. In operation, a user of the touch screen 200 uses a user pointer, such as a stylus, a finger, and/or the like, to select and/or actuate one or more of the plurality of selectable objects 230 to input text into the text input area 220. The virtual keyboard 210 may be utilized by a user of an electronic device, for example, to input text for a specific application, such as e-mail, instant messaging, browsing, and/or the like. The touch screen 200 comprises a plurality of selectable objects 230 and these plurality of selectable objects 230 are smaller than a user's fingertip, thereby rendering limited space between each of the plurality of selectable objects 230. This limited space may result in erroneous selection by the user. For example, the touch screen 200 may have a width of about 68 millimeter (mm) and a height of about 40.8 mm high, with a width and height of pixels of about 400 pixels wide by about 240 pixels high. Such a touch screen, when displaying the virtual keyboard 210, displays each of the plurality of selectable objects 230 with a size of about 37 pixels wide by about 33 pixels high, e.g., less than about 7 mm wide and less than about 6 mm high. The virtual keyboard 210 provides no tactile feedback for selection of the plurality of selectable objects 230. In such a case, a user may have difficulty targeting, or maintaining a pressure application on, an intended location on the virtual keyboard 210.

Figure 5:
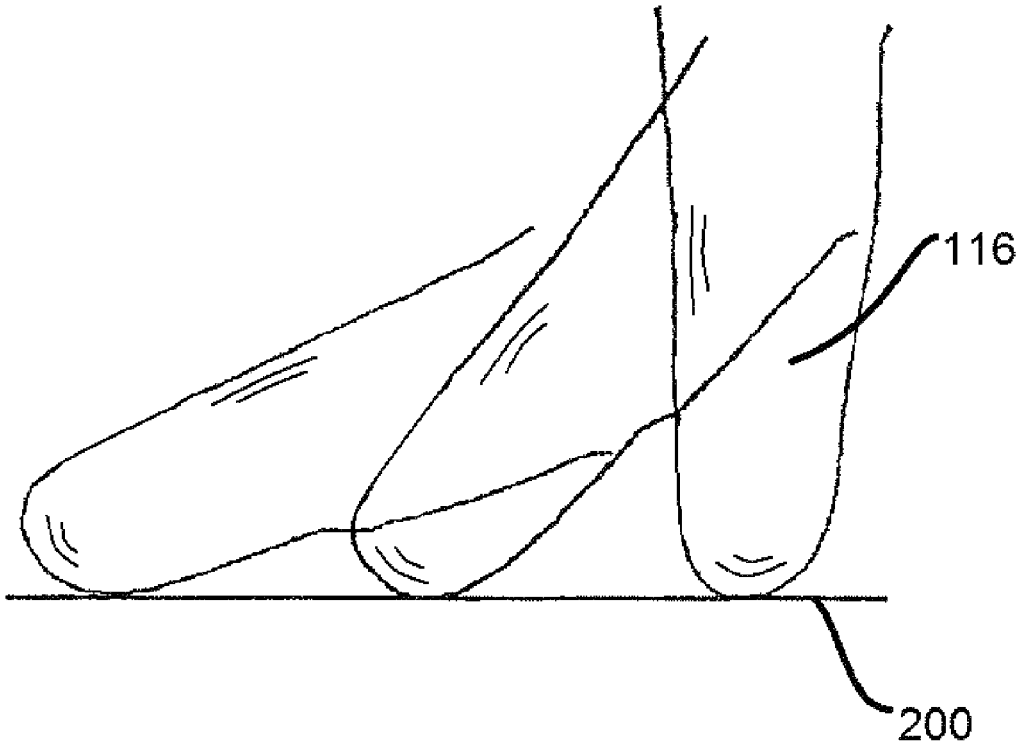
FIG. 5 is a side elevational view of the touch screen shown in FIG. 4.

A processor is configured to receive a user input within a selection area to select a given one of the plurality of selectable objects 230. Thus, if, for example, a user wearing the hand covering 100 manipulates the index finger accommodated in the index finger receptacle 116 such that the index finger receptacle 116 is brought into capacitance-interrupting contact with the virtual keyboard 210 in the vicinity of the letter "T", and if the user interface is further configured to display an expanded selection area based on the user input, the touch screen 200 will display an indicator 310, e.g., the letter "T", in an enlarged single character display area. The user may then confirm the selection by clicking or otherwise actuating the selection. In addition to a gesture such as the just-described "press and release" gesture, touch screens such as the touch screen 200 can be activated via several different activation gestures. For example, the tip of the index finger receptacle 116 can be slid across a limited extent of the touch screen, as shown in FIG. 5, which is a side elevational view of the touch screen 200 shown in FIG. 4. As another example, the tip of the index finger of the phone user can be slid along the touch screen in coordination with a sliding movement of the tip of the thumb of the phone user to expand and shrink the relative size of the data being displayed. This multi-touch gesture is often referred to as a "pinch and zoom" action. There are other multi-touch gestures as well, such as a rotation command. When a person touches the touch screen with the hand covering 100 having the conductivity enhancing sub-assembly 124, the input can be detected by the electronic device. Specifically, the conductivity enhancing sub-assembly 124 generates a change in a capacitive field on the touch screen on contact. The change in capacitance can be sensed and the input can be detected.

The conductivity enhancing sub-assembly 124 is herein described as comprised of a strand or strands that provide a capability to change a capacitance feature of a touch screen or other interactive surface and the description notes that the strand or strands have an "electro-conductivity" to accomplish this capability. In this regard, "electro-conductivity" is a term used herein to describe any phenomena that results in a change in the ability of the conductivity enhancing sub-assembly 124 to change a capacitance feature of a touch screen or other interactive surface. For example, the conductivity enhancing sub-assembly 124 may comprise components that generate or channel an electron flow (electrical conductivity) under prescribed conditions. Also, "electro-conductivity" as used herein includes phenomena occurring externally of the conductivity enhancing sub-assembly 124 that nonetheless result in a change in the ability of the conductivity enhancing sub-assembly 124 to change a capacitance feature of a touch screen or other interactive surface. For example, it is known that a person's skin has an electrical conductance capability and the configuration of the conductivity enhancing sub-assembly 124 in an operational association with a person's skin can result in a configuration in which the conductivity enhancing sub-assembly 124 is able to make use of the "electro-conductivity" of the person's skin. A configuration of the conductivity enhancing sub-assembly 124 in an operational association with a person's skin might include, for example, a placement of the conductivity enhancing sub-assembly 124 in direct contact with the skin on a finger of a person wearing the hand covering 100 or a placement of the conductivity enhancing sub-assembly 124 sufficiently proximate to the skin on a finger of a person wearing the hand covering 100 to bring about a change in the ability of the conductivity enhancing sub-assembly 124 to change a capacitance feature of a touch screen or other interactive surface.

Figure 3A:
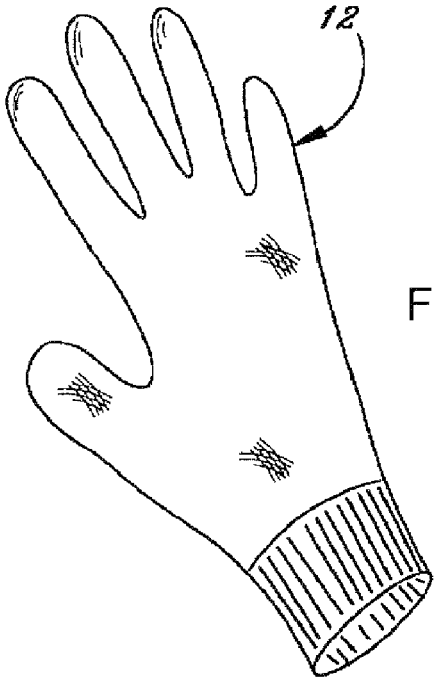
FIGS. 3*a*, 3*b*, and 3*c* are each a perspective view of a component of a prior art glove, the component together forming a seamless glove.
Figure 3B:
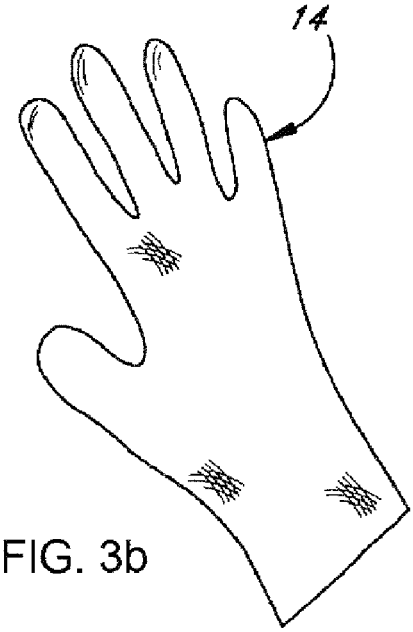
Figure 3C:
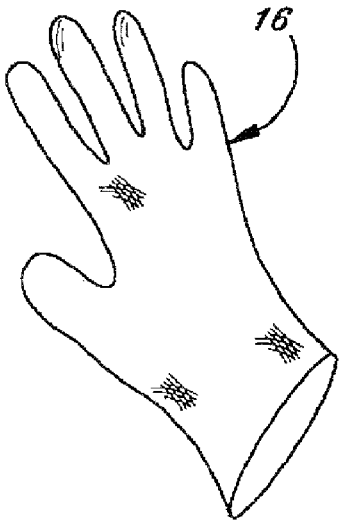

The hand covering 100 can be configured as a glove having seams or as a seamless glove. By virtue of the optimally reduced size and compact configuration of the conductivity enhancing sub-assembly 124, the hand covering 100 provides an optimal solution when configured as a seamless water-resistant glove with the touch screen contact capabilities. Seamless gloves are known in the art and, for example, as disclosed in U.S. Pat. No. 5,740,551 to Walker, a seamless glove can be manufactured according to one of several known seamless glove manufacturing processes. With reference to FIGS. 3*a*, 3*b*, and 3*c* herein, which illustrate a glove disclosed in U.S. Pat. No. 5,740,551 to Walker, it can be seen that a seamless glove suitable for use in connection with the sub-assembly 114 of the present invention can be in the form of the barrier glove 10 disclosed in U.S. Pat. No. 5,740,551 to Walker that includes three components: an outer layer or shell 12, a protective intermediate barrier insert 14, which is disposed within the shell, and an inner layer or insert 16, which is disposed next to the user's skin when worn. The outer layer 12 of the glove disclosed in U.S. Pat. No. 5,740,551 to Walker is preferably knitted out of aramid fibers, and can be constructed with a number of different types adhesive patterns on the outer surface to provide added durability and gripping ability. The shell 12 can comprise either in its entirety, or in-part the knitted material, and the shell 12 is preferably knitted with a jersey weft knit, allowing for ample stretch. According to U.S. Pat. No. 5,740,551 to Walker, the shell 12 is typically knitted on special glove knitting machines that fabricate the entire glove as one complete piece. U.S. Pat. No. 5,740,551 to Walker notes that seamed shells may have a tendency to limit the tactility and dexterity of the user by causing bumps and binding in the shell of the glove, and could inhibit hand functions. The shell 12 may include any of the following: a palm portion, a dorsal or back portion, finger stalls or passageways, a thumb stall or passageway, and a portion covering the wrist which defines an opening facing inwardly of the wearer and the barrier insert 14 and inner layer 16 each may include these glove features as well. U.S. Pat. No. 5,740,551 to Walker notes as well that other glove designs having less than four finger stalls, but at least one (e.g., a mitten design), may be manufactured instead of a five-finger glove shell. Additionally, the shell 12 may be provided with an elastically yielding area or draw strap proximate the portion covering the wrist to provide close contact of the entire glove to a wearer's wrist. The barrier insert 14 is fabricated from a gas permeable, liquid impermeable material, and a material suitable for use in the glove 10 for protecting a wearer from noxious liquids and gases such as, e.g., a laminate 18 comprising a membrane 20 of porous polytetrafluoroethylene having first and second membrane sides 22, 24, respectively. The inner layer or insert 16 eliminates the user's hand from contact with the oversized barrier insert 14 and is preferably knitted in one process so that no seams are created. The seamless inner layer 16, as with the shell 12, is preferably formed as one piece with no seams to enhance the tactility and dexterity of the glove.

Figures 6, 7:
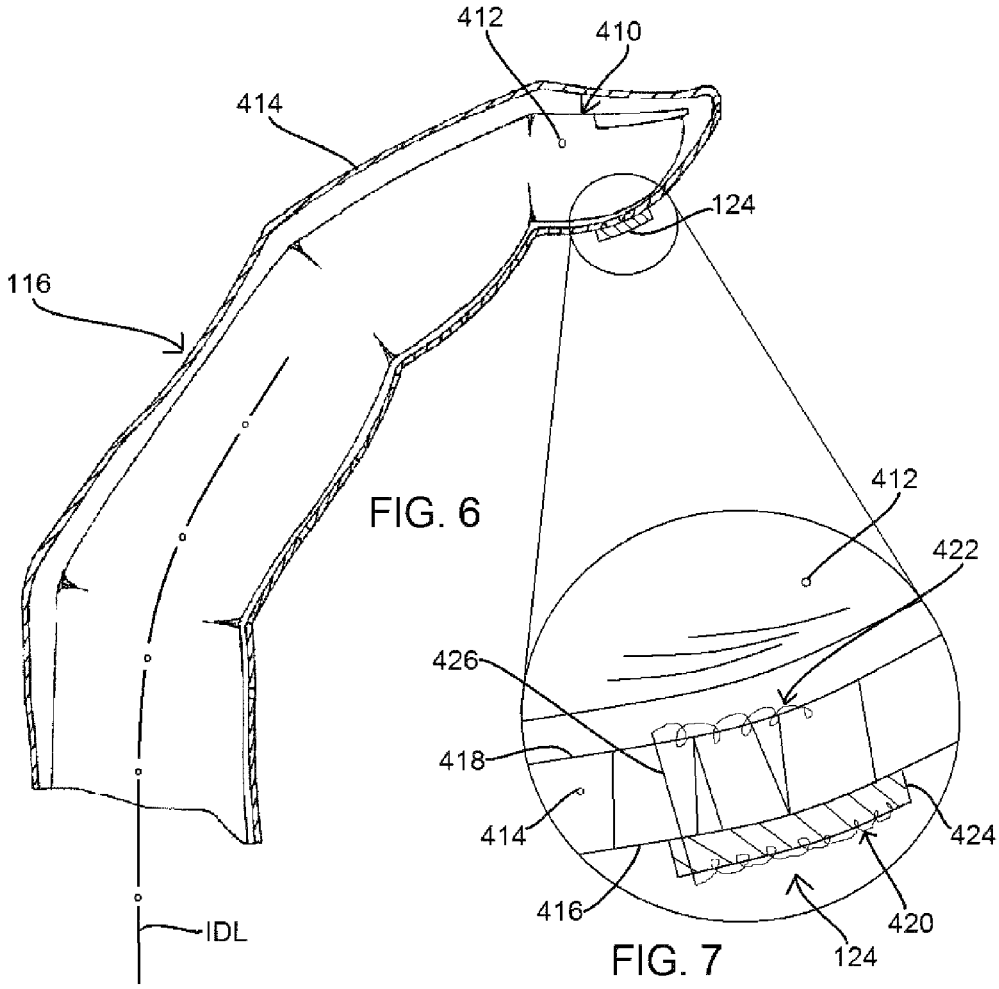
FIG. 6 is an enlarged sectional side elevational view of the index finger receptacle with an index finger of a user accommodated therein.
FIG. 7 is an enlarged sectional side elevational view of a portion of a tip of the index finger and a portion of the index finger receptacle.

With regard to further details of the hand covering 100 in a configuration thereof as a seamless water-resistant glove, each one of the thumb finger receptacle 114, the index finger receptacle 116, the middle finger receptacle 118, the ring finger receptacle 120, and the pinky finger receptacle 122 is formed with a sheath wall with an external surface and an internal surface, the internal surface delimiting a receiving volume in which one or more fingers of a user can be accommodated and the external surface and the internal surface delimiting therebetween the interior of the sheath wall. It is to be understood that the sheath walls of the finger receptacles of the hand covering 100 are formed in a similar manner of the same material and a exemplary description is now provided of the configuration of one of the finger receptacles—namely, the index finger receptacle 116—with reference to FIG. 6, which is an enlarged sectional side elevational view of the index finger receptacle 116 with an index finger 410 of a user accommodated therein and to FIG. 7, which is an enlarged sectional side elevational view of a portion of a tip 412 of the index finger 410 and a portion of the index finger receptacle 116. As seen in FIGS. 6 and 7, the index finger receptacle 116 has a sheath wall 414 with an external surface 416 and an internal surface 418, the internal surface 418 delimiting a receiving volume in which the index finger 410 can be accommodated and the external surface 416 and the internal surface 418 delimiting therebetween the interior of the sheath wall 414. The index finger receptacle 116 has a tip portion in which the fingertip 412 of the index finger 410 of the user is received and a base portion in which a base of the index finger 410 of the user is received. The index finger receptacle 116 has a longitudinal axis IDL delimited by the tip portion and the base portion.

The conductivity enhancing sub-assembly 124 is in the form of an outer strand 420 and an inner strand 422. The outer strand 420 has a metallic component and the outer strand 420 is secured to the external surface 416 of the index finger receptacle 116 at least two securement locations spaced from one another in the length direction along the longitudinal axis IDL. The external surface of the index finger receptacle 116 is provided with a target assist feature that is not present on the other finger receptacles of the hand covering 100. The target assist feature forms a portion of the external surface 416 of the sheath wall 414 of the index finger receptacle 116 and the target assist feature is in a predetermined relationship with the outer strand 420 and is operable to provide feedback to the user relating to a position of the outer strand 420. The target assist feature is a raised portion 424 of the sheath wall 414 of the index finger receptacle 116 that extends further in a projecting direction as viewed from the internal surface 418 of the sheath wall toward the external surface 416 of the sheath wall than the adjacent portions of the sheath wall of the index finger receptacle 116.

The outer strand 420 has several portions that each extends into the external surface 416 of the sheath wall 414 of the index finger receptacle 116 at one entrance location on the external surface 416 of the sheath wall, passes along a passage in the sheath wall interior, and extends outwardly of the external surface 416 of the sheath wall at an exit location of the external surface 416 of the sheath wall such that the outer strand 420 does not cross the interior surface 418 of the sheath wall of the receptacle. As seen in particular in FIG. 7, the outer strand 420 is formed of a series of loops each extending from the external surface 416 of the sheath wall 414 into the interior of the sheath wall 414 yet not penetrating or piercing through the interior surface 418 of the sheath wall 414.

The inner strand 422 has a metallic component and the inner strand 422 is secured to the interior surface 418 of the sheath wall 414 of the index finger receptacle 116. The outer strand 420 has a pair of ends, with one end being a free end projecting from the raised portion 424 of the sheath wall 414 of the index finger receptacle 116 and the other end being connected to the inner strand 422 in a manner to be described shortly. The inner strand 422 also has a pair of ends, with one end being a free end projecting from the interior surface 418 of the sheath wall 414 and the other end being connected to the outer strand 420. The outer strand 420 and the inner strand 422 are arranged relative to one another in an arrangement characterized by an interconnecting element 426 extending through the sheath wall 414 of the index finger receptacle 116 and connected to both the inner strand 422 and the outer strand 420. The interconnecting element 426 is in the form of a run of filament extending through the sheath wall 414 of the index finger receptacle 116 and connected to both the inner strand 422 and the outer strand 420. The interconnecting element 426 is connected to the outer strand 420 solely at a respective one of the pair of ends of the outer strand and the interconnecting element 426 is connected to the inner strand 422 solely at a respective one of the pair of ends of the inner strand.

The outer strand 420 and the inner strand 422 are associated with one another such that, when the index finger 412 of a user is accommodated in the index finger receptacle 116, an electrical conductivity path exists that includes the index finger 412, the inner strand 422, and the outer strand 420. The outer strand 420 and the inner strand 422 can alternatively be arranged relative to one another in an arrangement in which the interconnecting element 426 is not present but, instead, the electro-conductivity characteristics of the inner strand 422 and the outer strand 420 are configured such that sufficient electro-conductivity is transmitted therebetween for the index finger receptacle 116 to properly perform a capacitance interrupting operation on a touch screen or other interface even though the inner strand 422 and the outer strand 420 are not directly coupled to one another by a filament. As can be understood, the raised portion 424 of the sheath wall 414 of the index finger receptacle 116, by virtue of the fact that it projects outwardly relative to the remainder of the fingertip region of the index finger receptacle 116, provides convenient feedback to a user that the desired location on a touch screen or other interface has been properly contacted by the index finger receptacle 116.

Figure 8:
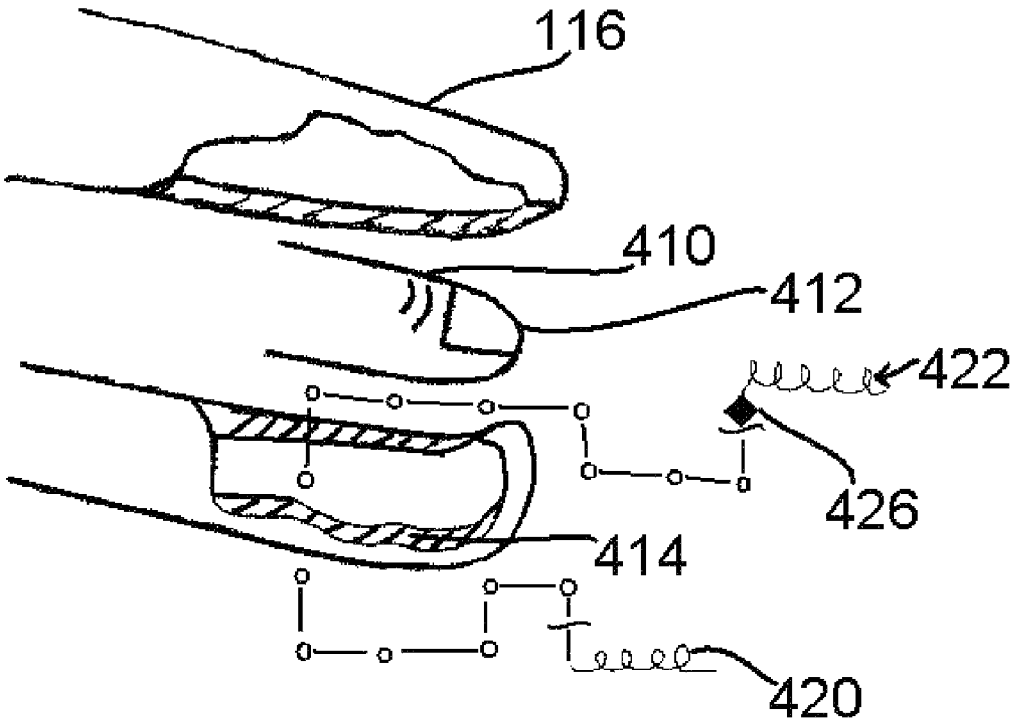
FIG. 8 is an exploded perspective sectional view of a portion of the index finger receptacle of one configuration of the hand covering in which the outer strand is a single column strand and the inner strand as a single column strand and showing the tip of the index finger of a user.

Reference is now had to FIG. 8, which is an exploded perspective sectional view of a portion of the index finger receptacle 116 of one configuration of the hand covering 100 and showing the tip 412 of the index finger 410 of a user. In this configuration of the hand covering 100, the outer strand is a single column strand and the inner strand is a single column strand and the outer strand and the inner strand extend generally parallel to one another on respective opposite internal and external sides of the sheath wall 414. The outer strand 420 and the inner strand 422 are arranged relative to one another in an arrangement characterized by an interconnecting element 426 extending through the sheath wall 414 of the index finger receptacle 116 and connected to both the inner strand 422 and the outer strand 420. The interconnecting element 426 is in the form of a run of filament extending through the sheath wall 414 of the index finger receptacle 116 and connected to both the inner strand 422 and the outer strand 420. The interconnecting element 426 is connected to the outer strand 420 solely at a respective one of the pair of ends of the outer strand and the interconnecting element 426 is connected to the inner strand 422 solely at a respective one of the pair of ends of the inner strand. In this configuration of the index finger receptacle 116, the external surface 416 of the sheath wall 414 does not comprise a raised portion, such as the raised portion described with respect to the configuration of the index finger receptacle 116 shown in FIGS. 6 and 7. In other respects, however, the configuration of the index finger receptacle 116 shown in FIG. 8 parallels that of the configuration of the index finger receptacle 116 shown in FIGS. 6 and 7.

The hand covering 100 can also be configured with a fingertip aligning feature that selectively permits the outer strand to operate with sufficient electro-conductivity to bring a capacitance interruption on a touch screen or blocks the outer strand from operating with sufficient electro-conductivity to bring a capacitance interruption on a touch screen with the electro-conductivity operation of the outer strand being permitted or blocked as a function of a prescribed alignment of the index finger 410 of a user within the index finger receptacle 116.

Figure 9:
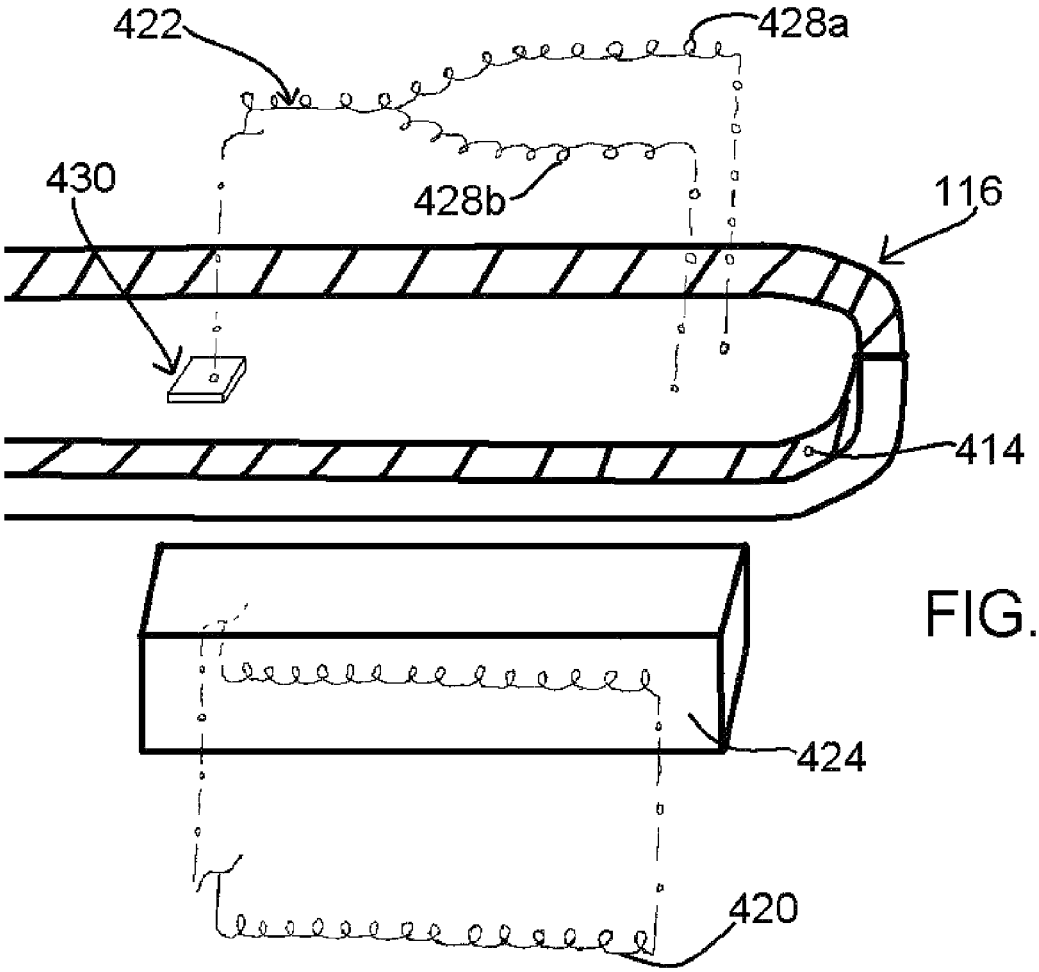
FIG. 9 is an exploded perspective view of a portion of the index finger receptacle and showing another configuration of the hand covering in which the outer strand is a single column strand and the inner strand as a forked strand having a left branch and a right branch.

This fingertip aligning feature will now be described with reference to FIG. 9, which is an exploded perspective view of a portion of the index finger receptacle 116 and showing another configuration of the hand covering 100 in which the outer strand 420 is a single column strand and the inner strand 422 is a forked strand having a left branch 428*a* and a right branch 428*b*. The left branch 428*a* and the right branch 428*b* are spaced from one another in a width direction perpendicular to the longitudinal axis IDL of the index finger receptacle 116 by a width spacing approximately the same as that of the fingertip of the index finger of a user having an index finger of average width. The left branch 428*a* and the right branch 428*b* are configured such that sufficient electro-conductivity is supplied to the outer strand 420 only if the fingertip 412 of the index finger 410 of a user is generally laterally centered between the left branch 428*a* and the right branch 428*b*. To this end, a respective inwardly protruding raised portion can be provided under each of the left branch 428*a* and the right branch 428*b* so that the user experiences a tactile indication that the fingertip of the index finger has been centered between the left branch 428*a* and the right branch 428*b*. This feature promotes an ergonomic positioning of a user's index finger during the time that the index finger receptacle 116 will be brought into contact with a touch screen or other interface and this variation of the hand covering 100 is described to exemplarily illustrate the enhancements that can be provided to the hand covering 100. The inner strand 422 is connected to a control unit 430 that may be in the form of a semiconductor or ASIC chip and which may optionally be provided with an energy source such as, for example, a voltaic battery. The control unit 430 is operable to control a flow of electrons to the outer strand 420 in response to, or as a function of, the operation of the inner strand 422. For example, in the event that the control unit 430 is in the form of an semiconductor and is provided a voltaic battery, the control unit 430 can be configured to generate to the outer strand 420 an electron flow supplemented by the voltaic battery in response to a detection by the control unit 430 that a user has generally laterally centered a fingertip between the left branch 428*a* and the right branch 428*b* of the inner strand 422.

Each of the outer strand 420 and the inner strand 422 is formed with a metallic component that comprises at least one type of metal-incorporating compound, metal-ion containing particles, or mixtures thereof. The term metal is intended to include any such historically understood member of the periodic chart (including transition metals, such as, without limitation, silver, zinc, copper, nickel, iron, magnesium, manganese, vanadium, gold, cobalt, platinum, and the like, as well as other types including, without limitation, aluminum, tin, calcium, magnesium, antimony, bismuth, and the like). Also, each of the outer strand 420 and the inner strand 422 may be an individual yarn or a yarn comprising individual fibers or yarns. The individual fibers or yarns may be of any typical source for utilization within fabrics, including natural fibers (cotton, wool, ramie, hemp, linen, and the like), synthetic fibers (polyolefins, polyesters, polyamides, polyaramids, acetates, rayon, acrylics, and the like), and inorganic fibers (fiberglass, boron fibers, and the like). The strand may be of any denier, may be of multi- or mono-filament, may be false-twisted or twisted, or may incorporate multiple denier fibers or filaments into one single yarn through twisting, melting, and the like. The strand may be produced of the same types of yarns discussed above, including any blends thereof. Such strands may be also be formed of a fabric including a knit, a woven, or a non-woven fabric, that is comprised of yarns. The measured resistance in ohms per square inch of each of the outer strand 420 and the inner strand 422 should be less than about 25, preferably less than 5, and most preferably less than 1 Ohm in order to provide a sufficiently electrically conductive fabric.

Figure 10:
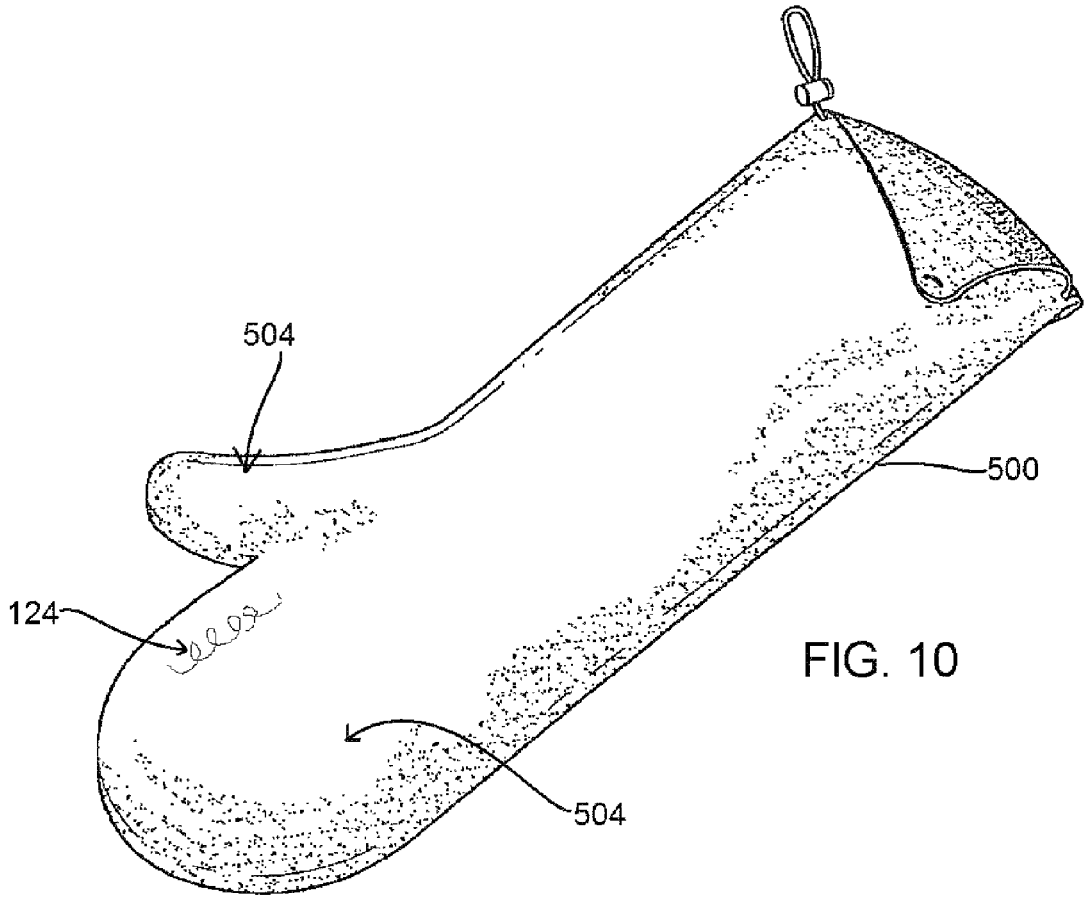
FIG. 10 is a top perspective view of another embodiment of the hand covering of the present invention in the configuration of a mitten.

FIG. 10 is a top perspective view of another embodiment of the hand covering of the present invention in the configuration of a mitten 500. The mitten 500 has a thumb receptacle 502 for accommodating therein a thumb of a user and a multi-finger receptacle 504 for accommodating therein the remaining fingers of a user. The mitten 500 is provided with the conductivity enhancing sub-assembly 124.

While an embodiment of the invention has been described and illustrated herein, it is to be distinctly understood that the invention is not limited thereto, but may be otherwise variously embodied and practiced within the scope of the following claims.

It is claimed:

1. A hand covering comprising:

at least one receptacle, the receptacle having a sheath wall with an external surface and an internal surface, the internal surface delimiting a receiving volume in which one or more fingers of a user can be accommodated and the external surface and the internal surface delimiting therebetween the interior of the sheath wall;

an outer strand, the outer strand having a metallic component and the outer strand being secured to the external surface of the receptacle at at least two securement locations spaced from one another in a length direction and the outer strand having at least one portion that extends into the external surface of the sheath wall of the receptacle at one entrance location on the external surface of the sheath wall, passes along a passage in the sheath wall interior, and extends outwardly of the external surface of the sheath wall at an exit location of the external surface of the sheath wall such that the at least one portion of the outer strand does not cross the interior surface of the sheath wall of the receptacle; and an inner strand, the inner strand having a metallic component and the inner strand being secured to the internal surface of the receptacle, the outer strand and the inner strand being associated with one another such that, when a finger of a user is accommodated in the at least one receptacle, an electrical conductivity path exists that includes the finger of the user, the inner strand, and the outer strand and the outer strand and the inner strand being arranged relative to one another in a selected one of the following arrangements: (a) an arrangement characterized by the absence of an interconnecting element extending through the sheath wall of the receptacle and connected to both the inner strand and the outer strand or (b) an arrangement characterized by at least one interconnecting element extending through the sheath wall of the receptacle and connected to both the inner strand and the outer strand.

2. The hand covering according to claim 1, wherein the outer strand and the inner strand being arranged relative to one another in an arrangement characterized by at least one interconnecting element extending through the sheath wall of the receptacle and connected to both the inner strand and the outer strand, the outer strand has a pair of ends, and the interconnecting element is connected to the outer strand solely at a respective one of the pair of ends of the outer strand.

3. The hand covering according to claim 2, wherein the inner strand has a pair of ends, and the interconnecting element is connected to the inner strand solely at a respective one of the pair of ends of the inner strand.

4. The hand covering according to claim 3 and further comprising a target assist feature on the external surface of the sheath wall of the receptacle, the target assist feature being in a predetermined relationship with the outer strand and being operable to provide feedback to the user relating to a position of the outer strand.

5. The hand covering according to claim 4, wherein the target assist feature is a raised portion of the sheath wall of the receptacle, the raised portion of the sheath wall of the receptacle extending further in a projecting direction as viewed from the internal surface of the sheath wall toward the external surface of the sheath wall than an adjacent portion of the sheath wall of the receptacle, the target assist feature forming a portion of the external surface of the sheath wall, and the outer strand having a target assist portion that extends into the target assist feature at one entrance location thereon, passes along a passage in the target assist feature, and extends outwardly of the target assist feature at an exit location target assist feature such that the target assist portion of the outer strand does not cross the interior surface of the sheath wall of the receptacle.

6. The hand covering according to claim 1 and further comprising another receptacle, the another receptacle having a sheath wall with an external surface and an internal surface, the internal surface delimiting a receiving volume in which one or more fingers of a user can be accommodated.

7. The hand covering according to claim 6 and further comprising four additional receptacles, each additional receptacle having a sheath wall with an external surface and an internal surface, the internal surface delimiting a receiving volume in which a finger of a user can be accommodated.

8. The hand covering according to claim 7, wherein the hand covering is a seamless glove.

9. The hand covering according to claim 8, wherein the outer strand and the inner strand being arranged relative to one another in an arrangement characterized by at least one interconnecting element extending through the sheath wall of the receptacle and connected to both the inner strand and the outer strand, the outer strand has a pair of ends, and the interconnecting element is connected to the outer strand solely at a respective one of the pair of ends of the outer strand, the inner strand has a pair of ends, and the interconnecting element is connected to the inner strand solely at a respective one of the pair of ends of the inner strand, and further comprising a target assist feature on the external surface of the sheath wall of the receptacle, the target assist feature being in a predetermined relationship with the outer strand and being operable to provide feedback to the user relating to a position of the outer strand.

10. The hand covering according to claim 9, wherein the target assist feature is a raised portion of the sheath wall of the receptacle, the raised portion of the sheath wall of the receptacle extending further in a projecting direction as viewed from the internal surface of the sheath wall toward the external surface of the sheath wall than an adjacent portion of the sheath wall of the receptacle.

11. A glove comprising:

a plurality of five receptacles, each receptacle having a sheath wall with an external surface and an internal surface, the internal surface delimiting a receiving volume in which a finger of a user can be accommodated, the internal surface of each receptacle delimiting therebetween the interior of the sheath wall, and each receptacle having a tip portion in which a fingertip of a finger of the user is received and a base portion in which a base of a finger of the user is received, and each receptacle having a longitudinal axis delimited by the tip portion and the base portion;

an outer strand, the outer strand having a metallic component and the outer strand being secured to the external surface of a respective one of the receptacles at at least two securement locations spaced from one another in the longitudinal direction and the outer strand having at least one portion that extends into the external surface of the sheath wall of the receptacle at one entrance location on the external surface of the sheath wall, passes along a passage in the sheath wall interior, and extends outwardly of the external surface of the sheath wall at an exit location of the external surface of the sheath wall such that the at least one portion of the outer strand does not cross the interior surface of the sheath wall of the receptacle, and the outer strand has a pair of ends; and an inner strand, the inner strand having a metallic component and the inner strand being secured to the internal surface of the one receptacle at at least two securement locations spaced from one another in the longitudinal direction, the inner strand has a pair of ends, the outer strand and the inner strand being substantially parallel to one another and being in at least partial overlapping relationship with one another as viewed relative to the longitudinal direction, the outer strand and the inner strand being associated with one another such that, when a finger of a user is accommodated in the at least one receptacle, an electrical conductivity path exists that includes the finger of the user, and the outer strand and the inner strand being arranged relative to one another in an arrangement characterized by at least one interconnecting element extending through the sheath wall of the receptacle and connected to both the inner strand and the outer strand, and the interconnecting element is connected to the outer strand solely at a respective one of the pair of ends of the outer strand, and the interconnecting element is connected to the inner strand solely at a respective one of the pair of ends of the inner strand.

12. The hand covering according to claim 11 and further comprising a target assist feature on the external surface of the sheath wall of the receptacle, the target assist feature being in a predetermined relationship with the outer strand and being operable to provide feedback to the user relating to a position of the outer strand.

13. The hand covering according to claim 12, wherein the target assist feature is a raised portion of the sheath wall of the receptacle, the raised portion of the sheath wall of the receptacle extending further in a projecting direction as viewed from the internal surface of the sheath wall toward the external surface of the sheath wall than an adjacent portion of the sheath wall of the receptacle.

14. The hand covering according to claim 11, wherein the hand covering is a seamless glove.

15. The hand covering according to claim 14, wherein the outer strand has a measured resistance in ohms per square inch of less than about 25, preferably less than 5, and most preferably less than 1 Ohm.

16. The hand covering according to claim 1, wherein the hand covering is a mitten.

17. The hand covering according to claim 1 and further comprising a component operatively connected to the inner strand for supplying electrical energy to the inner strand.

18. The hand covering according to claim 17 and further comprising a control unit for controlling the supply of electrical energy from the component operatively connected to the inner strand for supplying electrical energy to the inner strand.

19. The hand covering according to claim 18, wherein the control unit is a semiconductor chip.

* * * * *